US005226244A

United States Patent [19]

Carter et al.

[11] Patent Number: 5,226,244

[45] Date of Patent: Jul. 13, 1993

[54] CIRCULATING AIR DRYER

[76] Inventors: John L. Carter, 4045 NW. Carlton Ct., Portland, Oreg. 97229; Michael M. Sprague, 11650 SW. Ann, Tigard, Oreg. 97223

[21] Appl. No.: 816,655

[22] Filed: Jan. 3, 1992

[51] Int. Cl.[5] ..... F26B 21/06

[52] U.S. Cl. ..... 34/191; 34/34

[58] Field of Search ..... 34/191, 54, 22, 29, 34/219, 34

[56] References Cited

U.S. PATENT DOCUMENTS 2,055,834 9/1936 Bettenfield ..... 34/191 X 2,288,154 6/1942 Cobb ..... 34/191 X 4,250,917 2/1981 Jespersen et al. ..... 34/191 X

*Primary Examiner*—Henry A. Bennet

*Attorney, Agent, or Firm*—Kolisch Hartwell Dickinson McCormack & Heuser

[57] ABSTRACT

A drier which has a reversible power operated air mover for circulating air through multiple loads in either of opposite directions. An exhaust duct means is provided for removing moisture-laden air in a region between the loads, and a dilution air means is provided for introducing dilution air into this region. Means is provided for heating the dilution air introduced. The means for introducing air and with drawing air and for heating the air have the same operating characteristics irrespective of the direction of air movement.

12 Claims, 3 Drawing Sheets

CIRCULATING AIR DRYER

BACKGROUND AND SUMMARY OF THE INVENTION

This invention relates to circulating air dryers, such as might be employed in the drying of lumber. While the drying of lumber is specifically discussed herein, it should be understood that the dryer of the invention is not limited to the drying of lumber, as other products may be equally well dried using the principles contemplated.

In a conventional dryer, a system of fans inside a kiln or drying chamber maintains a more or less uniform flow of air through the lumber. The moving air supplies heat to the wood and removes the wood's moisture which is vented to the outside of the kiln. The wet bulb and dry bulb temperatures of the air passing through the lumber are controlled, and various drying schedules are used depending upon the moisture content of the wood, the wood species, and the end use of the lumber. In a typical kiln, moist air is exhausted through roof vents and as humid air is exhausted, drier colder outside air is drawn into the kiln which is heated within the kiln to operating temperature.

A conventional dryer wastes energy in several ways. For instance, humid air often is exhausted after it passes through heating coils within the dryer. This adds energy to the exhaust air, and this energy is wasted. In some dryers, after the humid air passes through heating coils, it is diluted and chilled with cold outside air and then recirculated. This system tends to waste energy, because originally humid air is heated and diluted before being exhausted. Complicating the problem of efficient use of energy is that in many dryers the direction of air flow through the dryer is reversed periodically. To have an efficient dryer with uniform operation, the way that make-up or dilution air is handled, humid air is exhausted, and heat is supplied to circulated air, should be in an essentially uniform manner, irrespective of the direction of the circulated air flow.

In Cook, Re Issue U.S. Pat. No. 28,226, a circulating air dryer is disclosed which has a construction obviating many of the disadvantages of conventional dryers. However, problems still exist with circulating air dryers, especially as used in multiple load applications, such as those known as a multi-track lumber kilns where circulated air passes through first one load and then another, and the humidity of the air rises on the air passing through the first load.

A general object of this invention, therefore, is to provide improvements in a circulating air dryer which contribute to a more efficient use of energy, and which also contribute to a more uniform type of drying than is obtainable with prior known dryers.

More specifically, an object is to provide an improved circulating air dryer where air flow through the dryer is periodically reversed, through reversal of an air mover or other instrumentality, and where a more efficient use of energy and more uniform dryer characteristics are obtainable, irrespective of the direction of air movement.

A further object is the provision of a circulating air dryer, specifically applicable to the drying of multiple loads, where air is circulated through the loads in either of opposite directions along a path, and where there is exhausting of humid air and introduction of dilution air in a zone disposed between the loads.

A related object is to provide such a construction which further includes means in the zone between loads for supplying heat to circulated air, and wherein the means for supplying dilution air and the means for extracting humid air are constructed in such a manner as to provide a uniform type of operation irrespective of the direction of air movement.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

As the term is used herein, a multi-load dryer refers to a dryer where there are at least first and second loads located within a drying chamber, and air producing the drying passes first through one and then the other of the loads, this air moving in a flow path for the circulated air. In a conventional multi-load dryer, as air passes through the first load, the energy in the air is used to evaporate water from the material, i.e. lumber being dried. The process is referred to as an adiabatic one, as there is constant energy drying. Evaporation causes a loss of dry bulb temperature, and energy associated with the loss of this dry bulb temperature is reflected in increased moisture in the air leaving the first load.

In multi-load dryers as known to date, means may be provided between the loads for reheating the air back to a control set point. For instance, in a steam heated kiln this means might take the form of steam coils. Air is reheated as it passes through the heating coils and this produces an increase in the wet bulb temperature. However, no moisture is removed, and no dilution air is introduced in the region between the loads, so even though the dry bulb temperature may be the same as that of the entering air, the wet bulb temperature is now higher as it enters the second load. Drying conditions are less sever and uniformity of drying is effected. Furthermore, moisture which has been evaporated from the first load passes through the heating coils provided between the load and is reheated. This adds energy to the moisture-laden air which will be exhausted after leaving the second load. This wastes energy.

What the invention contemplates is the provision of means for extracting exhaust air from the kiln and injecting dilution air into the kiln, in that region of the kiln which is intermediate a pair of loads of a multi-load dryer. Furthermore, the invention contemplates a construction for the means for heating air, extracting exhaust air, and injecting dilution air, which has the same operating characteristics, in the sense of efficiency and the manner of air introduction and removal, irrespective of the direction of air flow is occurring in the reversible air circulating dryer.

Figure 1:
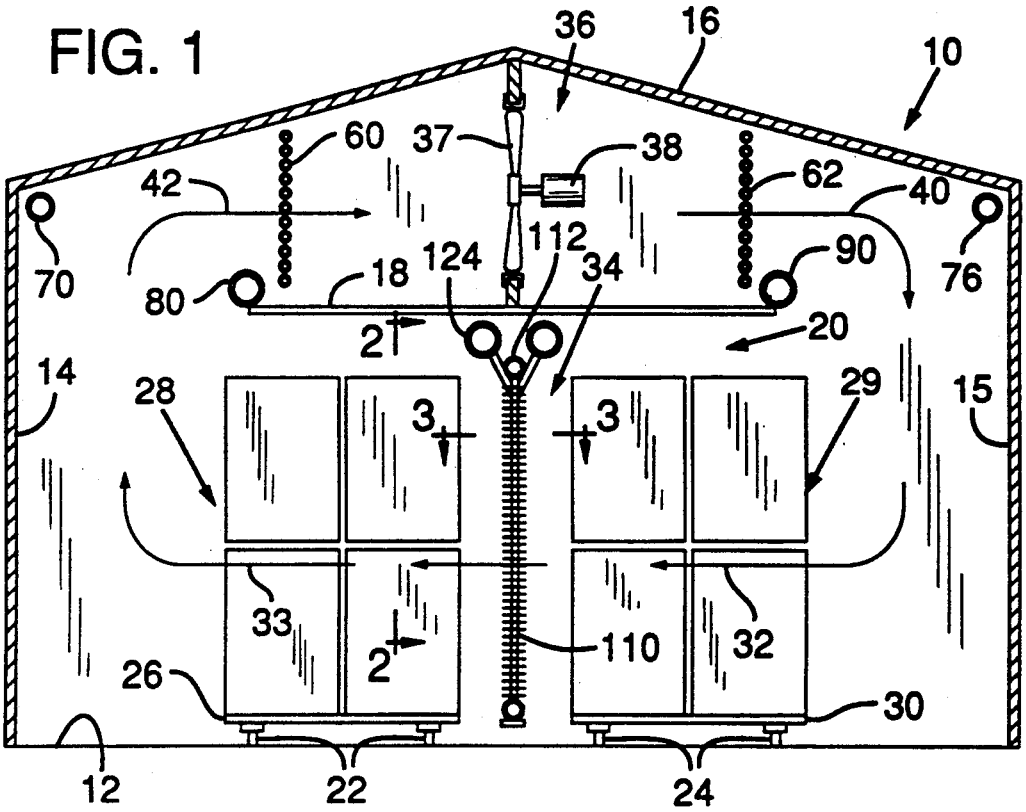
FIG. 1 is a cross-sectional view, in simplified form, illustrating a circulating air dryer for multiple loads.
Figure 2:
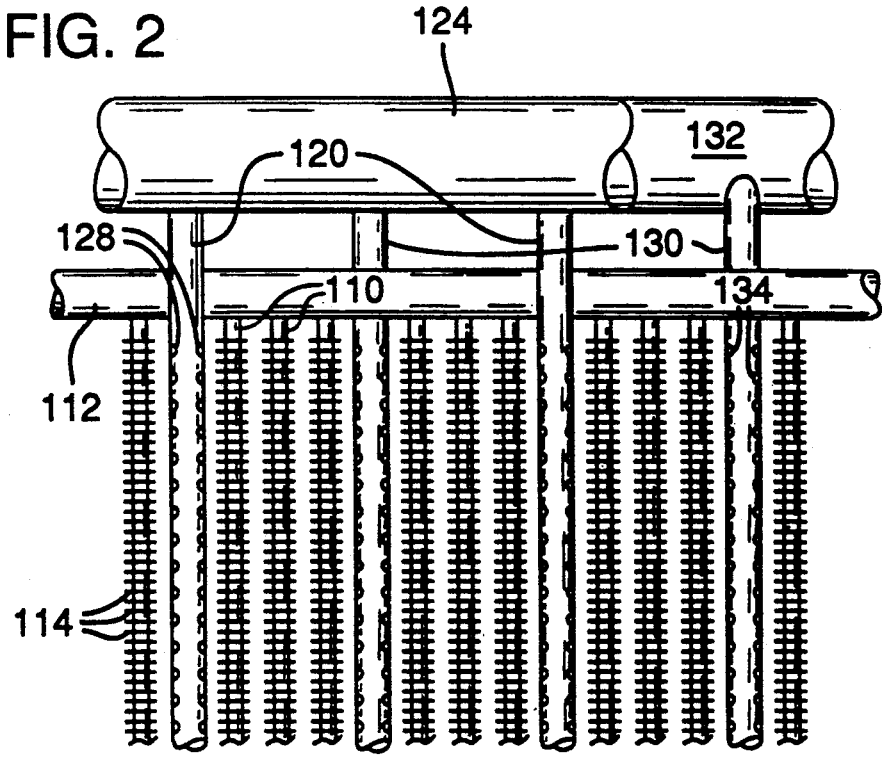
FIG. 2 is a sectional view, taken generally along the line 2—2 in FIG. 1, illustrating details of duct work and heaters in the construction.
Figure 3:
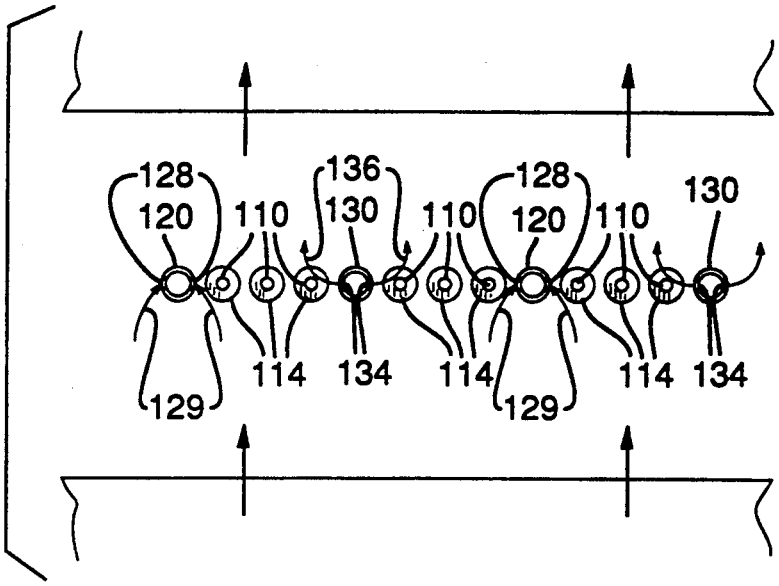
FIG. 3 is a view taken generally along the line 3—3 in FIG. 1.

Referring to the drawings, and initially to FIGS. 1, 2, and 3, a dry kiln or drying apparatus is indicated at 10. The kiln includes a floor 12, side walls such as those shown at 14, 15, and a roof 16. It should be understood that in the usual instance, the kiln has greater length than width, with the kiln illustrated having a greater length than the side-to-side dimension illustrated in FIG. 1 between side walls 14, 15.

Positioned downwardly from roof 16, and extending partially the distance between side walls 14, 15, is a horizontal platform 18. The platform is supported in a suitable manner. Below platform 18 and above floor 12 a drying chamber 20 is defined, which receives the product being dried, which in the case of the kiln specifically herein described is lumber. The kiln or dryer is a multiple load kiln in that it is capable of drying two loads at a time, with these loads spaced one from the other in the direction of the circulated air. Toward these ends, two sets of tracks, shown at 22 and 24, are provided, extending lengthwise along the bottom of the drying chamber. A wheel supported car or dolly 26 supported on tracks 22 provides a platform for the support of a load of stacked lumber shown at 28. Similarly, car 30 supported on tracks 24 provides support for a load of stacked lumber 29. In the usual instance, the lumber in loads 28 and 29 extends lengthwise in the load, or in a direction paralleling the tracks. Tiers or layers of lumber in a stack may be separated one from another by means such as sticks to enable air flow between these layers and across the stack.

As will be described in greater detail, the dryer of the invention includes a blower or air mover producing movement of circulated air in a horizontal flow path through drying chamber 20, with such air moving either from right to left as demonstrated by the arrows 32, 33, or in a reverse direction which is from left to right. The tracks and the cars supported on the tracks provide means in the dryer for supporting a pair of loads with these loads spaced from each other in chamber 20 in the path along which the air moves when traveling through the chamber. The dryer further provides a zone or region, shown at 34, intermediate these spaced loads.

In the space in the dryer existing between the roof and platform 18, and substantially midway between the sides of the dryer, is a blower means 36 or air mover in the form of a fan 37 driven by a motor 38. In the usual instance, more than one fan would be provided, with one following another in a direction extending lengthwise of the dryer. The blower means is reversible through reverse operation of the motor. Operation of the blower means in one direction produces air movement in a clockwise direction in FIG. 1, or in the direction of arrows 40, 32, 33, and 42. Operation of the blower means in the opposite direction produces air movement in a counter-clockwise direction with air moving from left to right in chamber 20.

Shown at 60 and 62 are sets of steam coils or heater means. As shown, a set is provided on each of opposite sides of the blower means. As illustrated in FIG. 1, the steam coils are shown as the cross sections of coiled steam pipes. It should be understood that the coils extend in elongate reaches extending the length of the dryer.

Duct or conduits are shown for exhausting and admitting air in a region above platform 18. Specifically, duct 70 extends the length of the dryer adjacent roof 16. This duct has ports in the wall thereof (not shown) permitting dilution air to flow from the interior of the duct into the interior of the dryer. A blower to be described draws air from the atmosphere and forces such out through these ports.

A similar duct 76 is used for the admission of make-up or dilution air on the opposite side of the dryer with air circulated in the opposite direction.

An exhaust duct 80 extends the length of the dryer on one side of the dryer. This duct has ports in the wall thereof accommodating air flow from the dryer interior into the interior of the duct. A blower to be described is operated to pull moist air from the dryer into duct 80 and thence exhaust such into the atmosphere.

A similar exhaust duct on the opposite of the dryer is shown at 90. This duct is used to exhaust moist air with air circulation in the opposite direction.

During operation of the dryer, with air moving as circulated by blower 36, such air travels first through one stack of lumber, thence into region 34 and thence into the other stack. On passing through the first load of material, energy from the hot air is used to evaporate water from the lumber causing a loss of dry bulb temperature. This loss of dry bulb temperature is accompanied with an increase in the moisture in the air. What this invention contemplates is the provision of means for reheating the air to increase its dry bulb temperature. Also contemplated is the provision for means for exhausting moisture-laden air from region 34 and replenishing such with dilution dry air which is effective to lower the wet bulb temperature of the air mixture which travels from zone 34 into the load that follows.

Referring again to FIGS. 1 through 3, shown at 110 are elongate finned heater pipes extending vertically in region 34, which is to say normal to the path of the air moving through the region. The pipes have upper ends connected to and communicating with a header pipe 112, which supplies the pipes with a heating medium such as steam. The fins of the pipes, shown at 114, promote faster dissipation of heat in the pipes into the gas mixture flowing through the pipes with operation of the dryer. The pipes are arranged as a bank and occupy a vertical plan.

Interspersed with these pipes are a series of exhaust ducts or conduits 120. These have upper ends connected to a common exhaust duct 124. A suitable blower is provided having its inlet connected to this exhaust duct 124. Ducts 120 have ports 128 in their sides distributed along their lengths. With operation of the blower producing a suction in duct 124, moisture-laden air within region 34 is pulled through ports 128 into exhaust ducts 120 with such then traveling into the common exhaust duct 124 to be expelled to the atmosphere.

Orifices 128 which extend in rows along opposite sides of exhaust ducts 120 face laterally and normal to the direction of moist air flow as it travels past the bank of ducts. The orifices in each duct permit moisture-laden air to be sucked inwardly into the duct from the stream of air which passes the duct, as demonstrated by the air flow arrows 129. This air is air which does not come in contact, for the most part, with the fins of the heater pipes. Furthermore, because of the laterally facing position of these ports, the operation of ducts 120 is the same regardless of whether air flow is from right to left in FIG. 1 or from left to right. In either case, air leaves the moving air stream to travel into the exhaust ducts essentially without moving over the fins of the heater coils.

Distributed with the elongate finned heater pipes 110 are additional ducts 130 which channel make-up or dilution air into the dryer. These ducts have upper ends connected to a common dilution duct 132.

Each of the dilution ducts 130 has a row of orifices or ports extending along each of opposite sides, exemplified by ports 134. When air under pressure is expelled through these ports, it travels outwardly in small jet streams to be carried across the fins of an adjacent heater pipe. This is demonstrated by the air flow arrows indicated at 136 in FIG. 3. As a consequence, dilution air is heated before becoming mixed with the circulated air within the dryer. It will also be realized that by reason of the laterally outwardly facing position of all these ports, the characteristics of the operation of the dilution ducts are the same, regardless of the direction of travel of the circulated air in the dryer. With air moving in either of opposite direction through the bank of pipes, dilution air will exit the dilution ducts to travel across the fins of the heater pipes and thence to become mixed with the circulated air.

Figure 4:
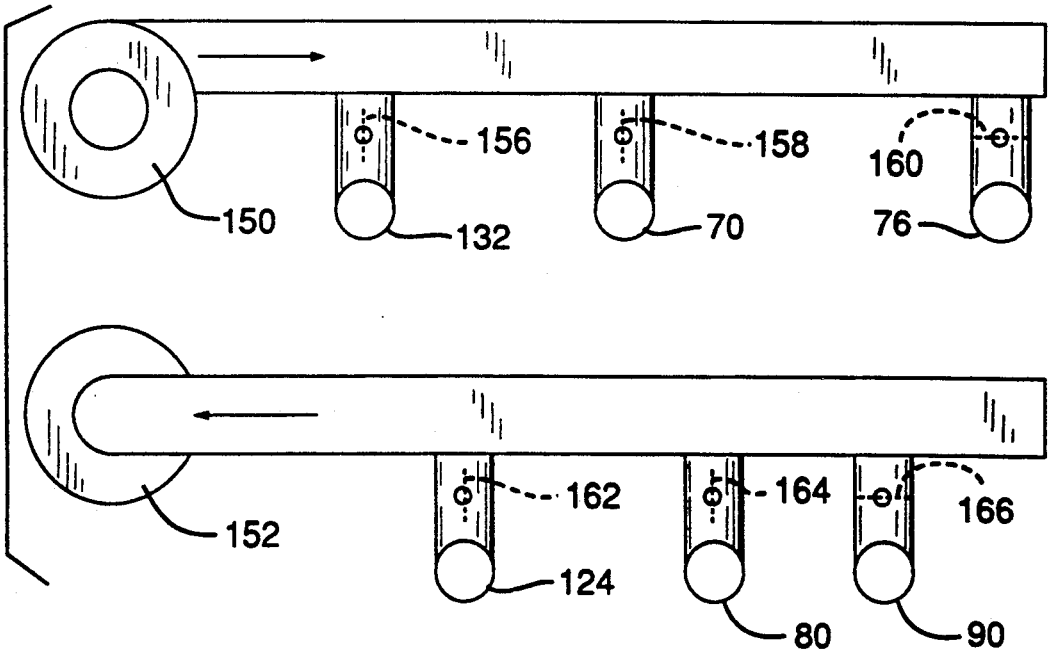
FIG. 4 schematically illustrates a blower system in the dryer.

In FIG. 4 there is illustrated schematically blowers and their connections with the various exhaust and dilution air ducts. Thus, common dilution duct 132 and ducts 70, 76 are connected to the exhaust side of a blower 150 which pulls air from the atmosphere and expels such into these various ducts. Exhaust ducts 124, 80, and 90 are connected to the intake side of a blower 152 which draws moisture-laden air from the interior of the dryer and expels such to the atmosphere. Dampers 156, 158, 160, are provided in the lines connecting ducts 132, 70, and 76 with blower 150. Dampers 162, 164, 166 are provided in the lines connecting ducts 124, 80, and 90 with blower 152. The dampers are operated to shut off duct 76 when duct 70 is operating, and to shut off duct 90 when duct 80 is operating. With the reverse flow, duct 70 is shut off with duct 76 operating, and duct 80 is shut off with duct 90 operating.

Figure 5:
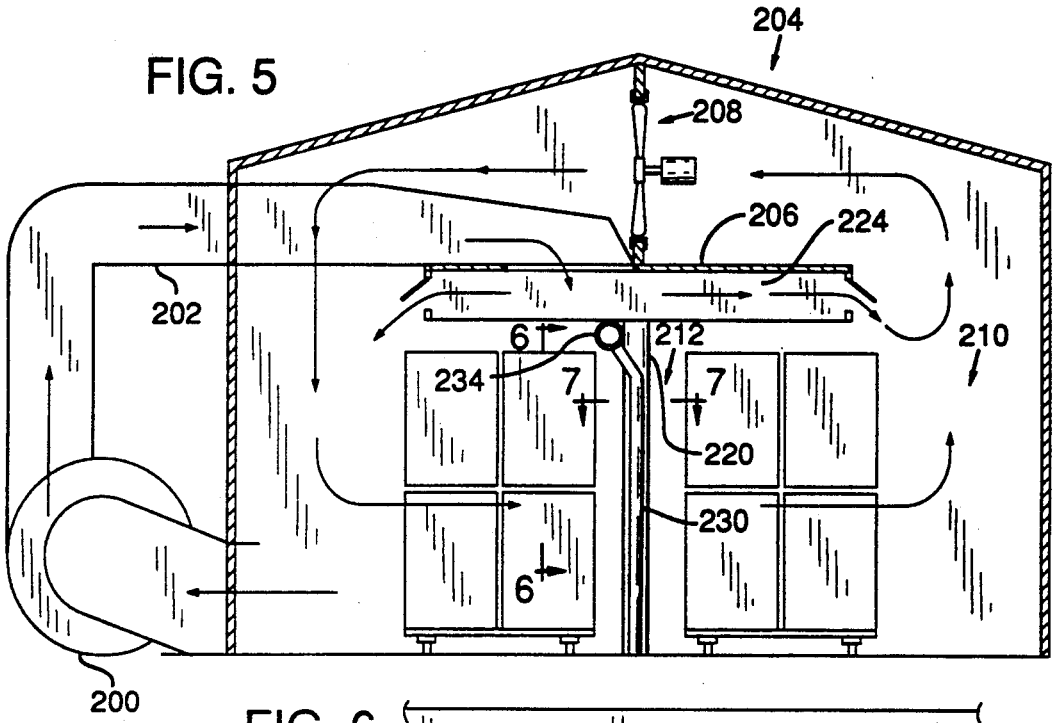
FIG. 5 is a view similar to FIG. 1 and illustrating a circulating air dryer, but showing a modification of the invention.
Figure 6:
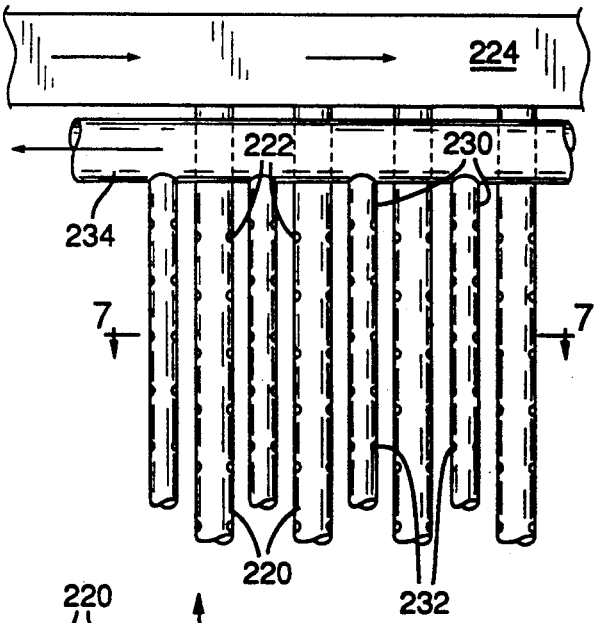
FIG. 6 and 7 are views taken along the lines 6—6 and 7—7, respectively, in FIG. 5.
Figure 7:
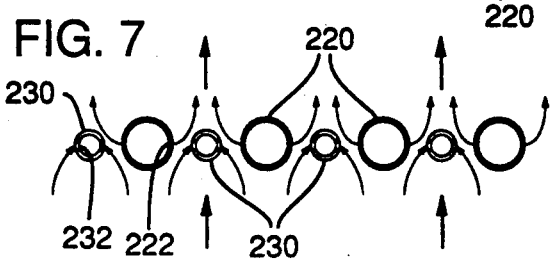

The invention incorporated with a so-called hot air dryer is illustrated in FIGS. 5, 6, and 7.

With the lumber dryer shown in these figures, a hot gas mixture is produced in burner chamber 200 as by burning a mixture of air and fuel gas. Gaseous hot combustion products from chamber 200 travel through a duct 202 to be discharged into the interior of a kiln 204. As in the first modification of the invention discussed, a platform 206 extends underneath the ceiling of the kiln and between this platform and the ceiling is a motor driven reversible blower means 208.

Stacks of lumber are supported within chamber 210 of the kiln. Between these stacks is region 212. Within this region structure is provided for withdrawing moisture laden air from the air which has just traveled through a stack and for introducing hot gases, i.e. hot air produced at the burner chamber into the region to replace this withdrawn moist air.

Specifically, vertical supply ducts are shown at 220. These have ports 222 arranged in vertical rows on opposite sides of each of the ducts. Upper ends are connected to a common chamber 224 supplied hot air by duct 202.

Interspersed with the supply ducts are plural exhaust air ducts 230. These are provided along opposite sides with a row of ports 232. These ducts have upper ends connected to a common exhaust duct 234.

With operation of the dryer, hot air supplied to ducts 220 exits from ports 222 to be carried with the circulated air downstream from the row of the supply ducts. Moisture-laden air is removed by being drawn into the exhaust ducts, and this in from regions of the air flow where introduction of hot air from the supply ducts 220 has not yet occurred, as shown in FIG. 7.

While modifications of the invention have been described, it should be obvious that other variations and modifications are possible without departing from the invention.

It is claimed and desired to secure by Letters Patent:

1. In apparatus for the drying of product with circulated air in a chamber, the chamber having a space for the reception of the product, said space having first and second product-receiving locations, spaced from each other and separated by a zone disposed between said locations;

reversible heated air flow means remote from said chamber for producing movement of air in a path extending through the chamber in either of opposite directions, with said air when moving in one direction moving through said first location and then through said zone and then through said second location, and when moving in an opposite direction moving through said second location and then through said zone and then through said first location, said reversible heated air flow means including a heater remote from said chamber and an air introducing and removing means remote from the chamber controlled in response to the direction of the movement of the heated air for introducing dilution air and removing moisture-laden air in the air moved;

an exhaust duct opening directly to said zone for exhausting moisture-laden air that has traveled through one location but before traveling through the other location; and a supply duct opening directly to said zone for introducing air to replenish the air exhausted by said exhaust duct.

2. The apparatus of claim 1, and which further comprises a hot air producer connected to said supply duct.

3. The apparatus of claim 1, and further comprising forced air means drawing air from the atmosphere supplying air to said supply duct.

4. In apparatus for the drying of product with circulated air in a chamber, the chamber having a space for the reception of the product, said space having first and second product-receiving locations spaced from each other and separated by a zone disposed between said locations;

a reversible power-operated air mover for selectively moving air through said space in either a direction extending through the first and then the second location or in an opposite directing extending to the second and then through the first location, an exhaust duct opening to said zone for exhausting moisture-laden air that has traveled through one location but before traveling to the other location, and a supply duct opening to said zone for introducing air to replenish the air exhausted by said exhaust duct, air on moving between the first and second locations moving through said zone and along a flow path, said supply duct extending in said zone transversely of said path and the supply duct having ports providing a connection between the interior of the supply duct and said zone providing air supply paths extending normal to the flow path of circulated air.

5. The apparatus of claim 4, wherein said exhaust duct extends in said zone transversely of said flow path, said exhaust duct has ports providing a connection between the interior of the exhaust duct and said zone and defining air exhaust paths for moisture-laden air exhausted from said zone extending normal to said flow path.

6. The apparatus of claim 5, which further comprises an elongate expanse of heater surfaces in said zone for heating air moved by said air mover, said expanse extending transversely of the path of circulated air.

7. The apparatus of claim 6, wherein the ports in the supply duct and the ports in the exhaust duct occupy a substantially common plane and the heater surfaces of said elongate expanse on opposite sides of said plane.

8. The apparatus of claim 7, wherein said elongate expanse has a center axis, and said supply duct, exhaust duct and axis of said expanse are parallel and in said common plane.

9. In a dryer for drying product, a chamber, a first load station and a second load station located in said chamber with the stations spaced from each other in the chamber and separated by a zone, reversible heated air flow means remote from said chamber for producing movement of heated air in a path extending through the chamber in either of opposite directions, with said air when moving in one direction moving through said first location and then through said zone and then through the second location, and when moving in an opposite direction moving through the second location and then through the zone and then through the first location, air-extraction means with an intake directly connected to said zone for extracting air from said zone between said locations with the air moving in either of opposite directions, and dilution air introducing means with an outlet connected directly to said zone for introducing dilution air into said zone with air moving in either of opposite directions.

10. In a dryer for drying product, a chamber, a first load station and a second load station located in said chamber with the stations spaced from each other in the chamber, and separated by a zone, reversible heated air flow means remote from said chamber for producing movement of heated air in a path through the chamber in either of opposite directions, with said air when moving in one direction moving through said first location and then through said zone and then through the second location, and when moving in an opposite direction moving through the second location and then through the zone and then through the first location, means for extracting air from said zone between said locations with the air moving in either of opposite directions, means for introducing dilution air into said zone with air moving in either of opposite directions, and an elongate air heating means located in said zone between said first and second locations for heating air moving in said path in either of opposite directions, said elongate heating means extending transversely of said path.

11. The dryer of claim 10, wherein the means for extracting air from said zone comprises an elongate exhaust duct extending transversely of the path of moving air in said zone, said exhaust duct having ports extending through the wall thereof providing air exhaust paths into the ducts that are normal to the path of air through said zone.

12. The dryer of claim 11, wherein said means for introducing dilution air comprises a supply duct extending in said zone transversely of the path of moving air through the zone, said supply duct having ports extending through the wall thereof providing air supply paths passages extending generally normal to the path of air in said zone.

* * * * *